United States Patent [19]

Stenqvist

[11] Patent Number: 4,950,217

[45] Date of Patent: Aug. 21, 1990

[54] BAG MAKING MACHINE WITH COUPLING-CONTROLLED PERFORATING AND WELDING

[75] Inventor: Jan N. Stenqvist, Kvidinge, Sweden

[73] Assignee: Fas Converting Machinery Aktiebolag, Ystad, Sweden

[21] Appl. No.: 347,043

[22] PCT Filed: Nov. 5, 1987

[86] PCT No.: PCT/SE87/00518

§ 371 Date: Apr. 12, 1989

§ 102(e) Date: Apr. 12, 1989

[87] PCT Pub. No.: WO88/03474

PCT Pub. Date: May 19, 1988

[30] Foreign Application Priority Data

Nov. 5, 1986 [SE] Sweden ..... 86047560

[51] Int. Cl.[5] ..... B31B 23/14; B31B 23/64

[52] U.S. Cl. ..... 493/197; 493/22; 493/24; 493/195

[58] Field of Search ..... 493/11, 13, 22, 24, 493/29, 195, 196, 197, 198

[56] References Cited

U.S. PATENT DOCUMENTS 3,147,168 9/1964 Bateman ..... 493/205

3,797,368 3/1974 Martelli ..... 493/197

FOREIGN PATENT DOCUMENTS 2059630 4/1981 United Kingdom ..... 493/196

*Primary Examiner*—William Terrell

*Attorney, Agent, or Firm*—Beveridge, DeGrandi & Weilacher

[57] ABSTRACT

An arrangement in a bag-making machine for forming bag-defining lines of perforation and weld lines in an elongate web (7) comprises a driven roller nip including a nip roller (4) and a backup roller (5), by means of which the web (7) is fed through the machine (1), an elongate cutter (10) which is parallel to the rollers (4, 5) and rotatable about its longitudinal axis, and which when rotated is moved into engagement with the back-up roller (5) for making the lines of perforation, and two welding units (8) with sealing jaws (22) for making the weld lines. In order to allow optional adjustement of the spacing between consecutive lines of perforation and weld lines, the cutter (10) is separately connectible and disconnectible independently of the operation of the roller nip (4, 5) or of other drive means in the machine (1). The cutter (10) and the welding units (8) and driven by quick-acting step couplings for stepwise rotation of the cutter (10) through predetermined angles and for stepwise displacement of the sealing jaws (22). An angle sensor measuring the web length fed to the machine (1) controls the rotation of the cutter (10).

9 Claims, 3 Drawing Sheets

BAG MAKING MACHINE WITH COUPLING-CONTROLLED PERFORATING AND WELDING

Figure 1:
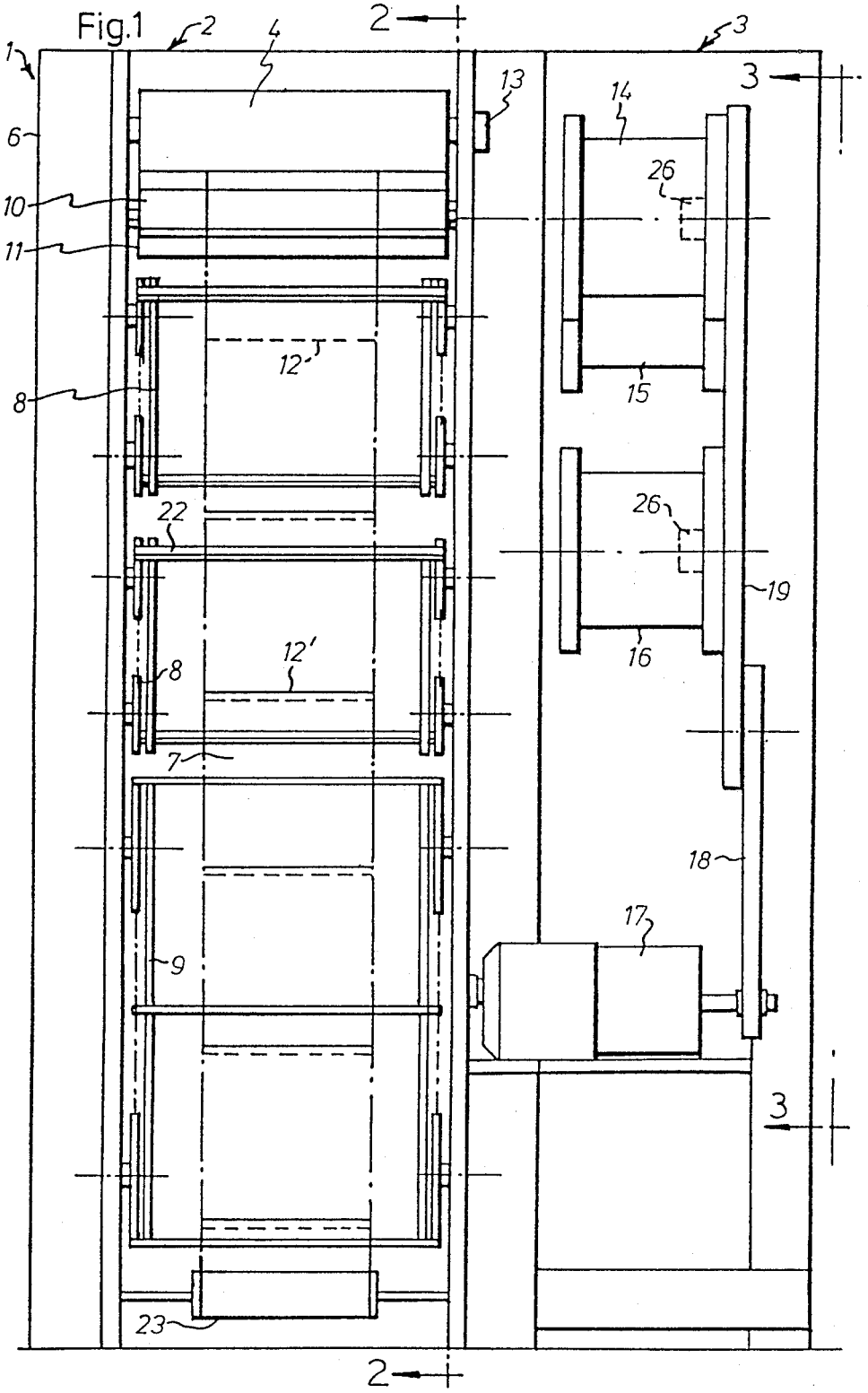

The present invention relates to an arrangement in a bag-making machine for forming bag-defining lines of perforation and weld lines in an elongate web, said machine comprising a driven roller nip including a nip roller and a back-up roller, by means of which the web can be fed into and through the machine, elongate cutting means disposed parallel to said rollers and rotatable about its longitudinal axis, said cutting means being movable into engagement with said back-up roller for making said lines of perforation, and a welding station comprising sealing jaws which are displaceable in the direction of travel of the web and movable into engagement with the web for making said weld lines as the web is moving.

The technique on which this invention is based is represented by a known bag-making machine into the upper part of which an elongate web is fed by means of a roller nip consisting of two rollers. Parallel to one roller, the back-up roller, there is mounted an elongate knife or cutter which is rotatable about its longitudinal axis and whose cutting edge, when rotated, impinges on the back-up roller for producing the lines of perforation in the web passing over the roller. The rotary knife thus impinges on the back-up roller once per revolution and thus produces lines of perforation which, by the continuous feed of the web, will be provided with predetermined spacings for forming bag lengths. After being perforated, the web passes vertically down through the machine past a welding station comprising sealing jaws which are moved in the direction of travel of the web and brought into engagement with the web for making weld lines as the web is moving.

In this known bag-making machine, the knife and the welding station are mechanically interconnected by means of a chain transmission, which entails a number of drawbacks. The operation of the knife and, thus, of the welding station is controlled by an angle sensor connected to the nip roller and measuring the speed of the web or the web length passing the nip roller. Since the knife and the welding station are connected to each other by means of a common chain transmission, it is not possible to set the spacing between the lines of perforation and the weld lines when the machine is in operation. Further, the stop position of the knife before impinging on the backup roller is conditioned by neither the knife nor any sealing jaw being in contact with the web in the stop position. With regard to the rotation of the knife and its cooperation with the sealing jaws of the welding station, the stop position of the knife is limited, in constructional respect, to a maximum so-called impact angle of about 45°. This means that the angle through which the knife edge is decelerated and accelerated before impact varies, which means that at high web speeds the knife will not have time to attain an optimal angular velocity at the impact.

Another drawback is that the knife and the welding station must be arranged relatively close to each other, which entails that the stop position of the knife before the impact is such that the knife edge is situated near the back-up roller and that the angle through which the knife is accelerated becomes limited. A target value of the angle between the stop position of the knife and its impact position is, as stated above, at most about 45°.

A further drawback of the known bag-making machine, which has only one knife, is that the minimum bag length that can be produced is mathematically determined, i.e. the circumference of the circular arc which the knife edge describes during its rotation; in mathematical terms, $2\pi$ x the distance between the centre of rotation of the knife and the knife edge.

Moreover, the known bag-making machine has proved too slow in operation considering the new bag-making materials which have been developed in recent years. With these materials, the extruder in which the material is extruded into a so-called hose must be run at a higher speed, which means that also the succeeding machines in a production line, e.g. the bag-making machine, must be run at a higher speed. Thus, there is a need for a fast-operating bag-making machine which can stand up to the required increase of the web velocity and, thus, provide an increase in production obtained with the new materials.

Thus, the present invention has for its object to overcome the above-mentioned drawbacks by providing a fast-operating arrangement which is intended for a bag-making machine and the operation of which is mechanically independent of other transmissions or means in the bag-making machine and which allows optional adjustment of the relative spacing between the lines of perforation and, also, the spacing between these lines and adjacent weld lines.

Another object of the invention is to ensure that the stop position of the cutting means, before impinging on the back-up roller, should be adjustable for optimizing the speed of the knife edge at the impact.

A further object is to make it possible to produce relatively short bags independently of the operation of the cutting means or its mechanical dependence on the other components of the bag-making machine These and further objects indicated hereinafter have now been achieved by the arrangement stated in the introduction to this specification, which is characterized in that the cutting means is separately connectible and disconnectible independently of the operation of the roller nip or of other drive means for optionally setting the spacing between the lines of perforation, and that the welding station is also separately connectible and disconnectible for optionally setting the spacing between the weld lines and the lines of perforation.

Preferred embodiments of the arrangement according to the invention are stated in the accompanying subclaims.

The invention will be described in more detail hereinbelow with reference to the accompanying drawings showing a preferred embodiment of an arrangement according to the invention included in a bag-making machine.

Figure 2:
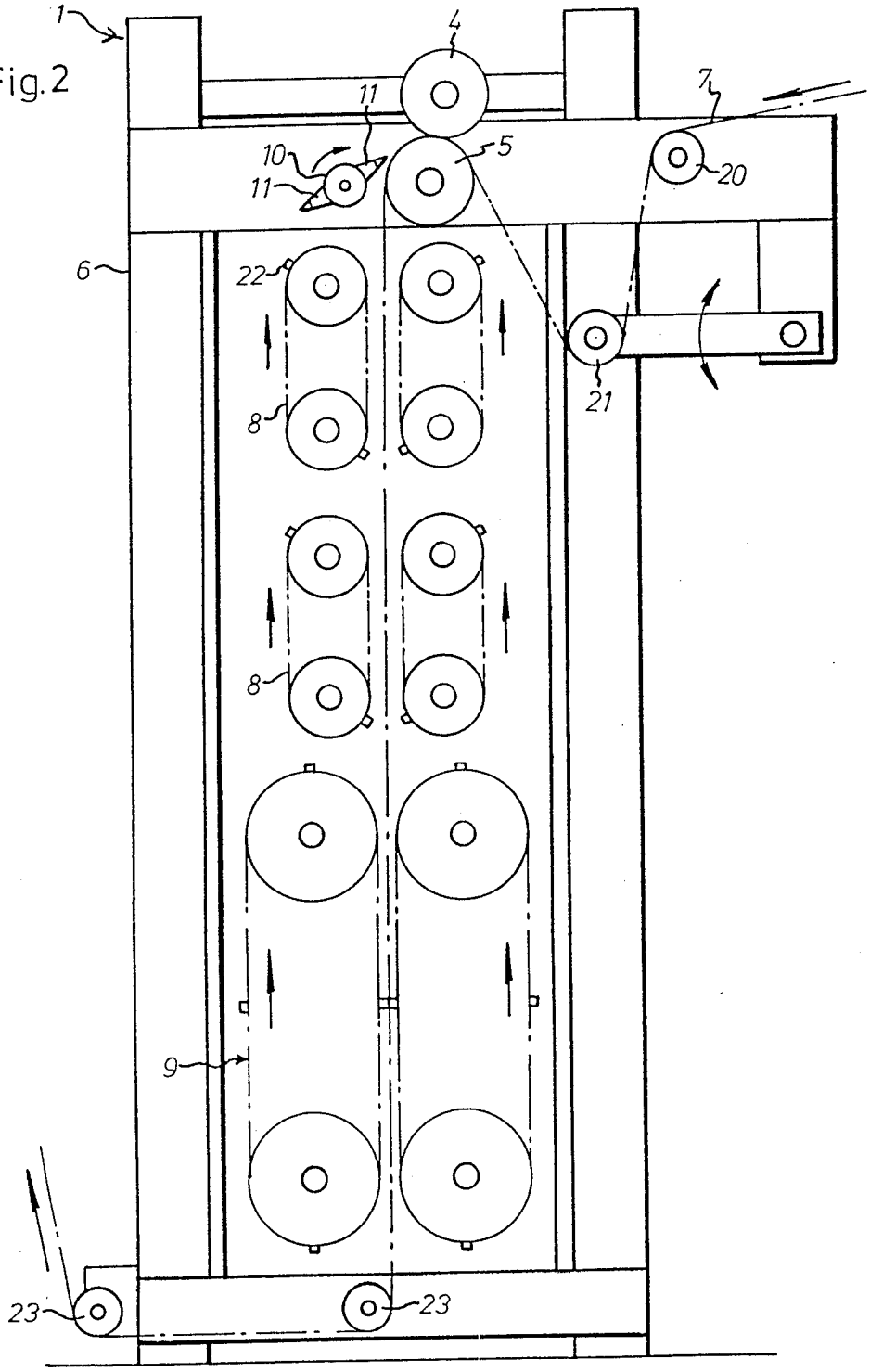
Figure 3:
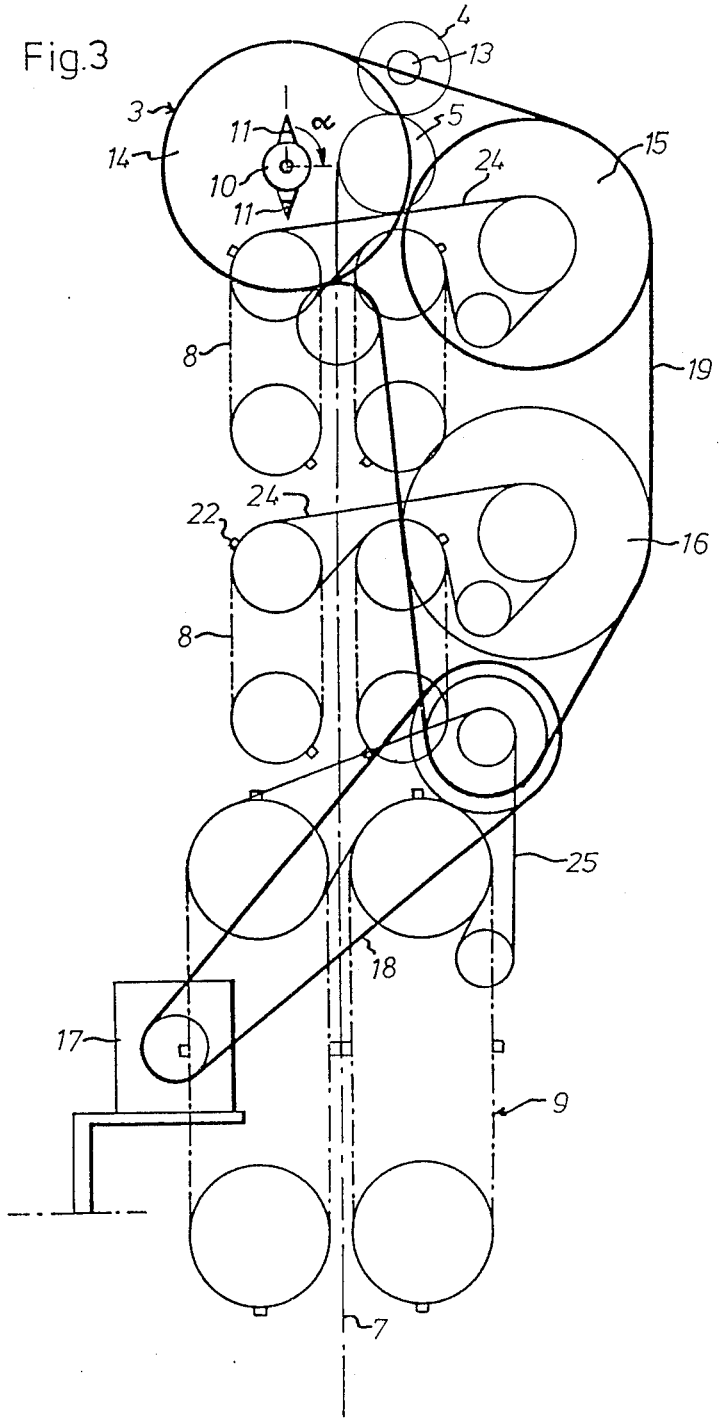

FIG. 1 shows the bag-making machine and the arrangement according to the invention included therein schematically from in front. FIG. 2 shows the bag-making machine in a side view taken along the line II—II in FIG. 1. FIG. 3 shows the transmissions of the bag-making machine in a side view taken along the line III—III in FIG. 1.

FIG. 1 shows a bag-making machine 1 including the arrangement according to the invention and having a perforation, welding and cooling unit 2 and a transmission unit 3. In the upper part of the bag-making machine 1, there is a roller nip with a nip roller 4 and a back-up roller 5 which are mounted in a frame 6. As best seen in FIG. 2, a web 7, preferably of plastic material, is fed into the machine 1 by means of the rollers 4, 5 and passes vertically downwards via two similar welding units 8 and a cooling station 9 to be further described hereinbelow. Opposite the back-up roller 5, there is provided a cutting means 10 which is rotatably mounted in the frame 6 and has two similar, diametrically disposed, exchangeable knives 11 which, when the cutting means 10 is rotated, are caused to impinge on the web 7 passing over the back-up roller 5, for producing transverse lines of perforation 12. The spacing between two consecutive lines of perforation 12 thus defines a bag length. The edge of each knife 11 is provided with teeth in a known manner.

To the nip roller 4 is connected an angle sensor 13 measuring the web length fed into the machine 1. The angle sensor 13 emits signals to the cutting means 10 in a way to be described in more detail hereinbelow.

The transmission unit 3 includes three similar, fast-operating, separately connectible and disconnectible step couplings, the first 14 of which drives the cutting means 10 while the other two 15, 16 each drive a welding unit 8. The step couplings 14, 15, 16 are driven by an electric motor 17 via a drive transmission 18 in the form of a toothed belt and a coupling transmission 19, also in the form of a toothed belt. The toothed belts mesh with external teeth on the couplings 14, 15, 16. The transmissions 18, 19 may of course consist of other drive means in the form of endless loops, e.g. chains.

FIG. 2 clearly illustrates the function of the bag-making machine 1 during operation. The web 7 is fed in a known manner into the machine via a guide roller 20 and a hingedly mounted floating roller 21. The web 7 is thereafter perforated by means of the rotating cutting means 10 and thereafter passes to the welding units 8 each of which comprises two opposing chain and guide pulley devices which are previously known and therefore not described in more detail here. In this context, it should merely be mentioned that these devices include transverse sealing jaws 22 which are moved into engagement with each other so as to clamp the web 7 descending through the machine 1. The sealing jaws 22 have electric conductors producing weld lines 12' adjacent the lines of perforation 12 produced by the knives 11. The arrangement is such that the upper welding unit 8 produces weld lines 12' at the lines of perforation 12 made by one knife 11 while the lower welding unit 8 produces weld lines at the lines of perforation 12 made by the other knife 11. Downstream of the welding units is located the cooling station, generally designated 9, which is of known type and therefore will not be described in more detail here. Finally, the web 7 leaves the machine 1 via two guide rollers 23.

In FIG. 3, the transmission unit 3 is shown in more detail. The above-mentioned toothed belts 18, 19 for driving the step couplings 14, 15, 16 are indicated by full, bold lines. As counted inwardly in the plane of the drawing, there are then provided two identical chain drives 24 for the welding units 8 and a chain drive 25 for the cooling station 9. The chain drives 24, 25 are of conventional type and will therefore not be described in more detail.

During the operation of the bag-making machine 1, the step couplings 14, 15, 16 are constantly driven by the toothed belts 18, 19, in turn driving the cutting means 10 and the two welding units 8. As discussed in the foregoing, one object of the invention is to make the cutting means 10 and the welding units 8 independent of other transmissions included in the machine 1 for allowing optional adjustment of the spacing between consecutive lines of perforation 12 and adjacent weld lines 12'. For this reason, the angle sensor 13 connected to the nip roller 4 measures the web length fed into the machine and thereafter, via an electric control equipment (not shown), emits signals to the step coupling 14 which very quickly activates or connects the cutting means 10 such that one knife 11 is rapidly accelerated from stop position to impact position and thereafter decelerated. The step coupling 14 is automatically disconnected after half a revolution by means of a schematically shown photo cell 26 included in the coupling. At the same time as the step coupling 14 is connected, the step couplings 15, 16 are also connected for operating the welding units 8. The two step couplings 15, 16 associated with the welding units 8 have photo cells 26 for interrupting operation. In this manner, it is ensured that the weld lines 12' produced in the welding units 8 are correctly positioned in relation to the lines of perforation 12 made by the knives 11. By means of adjusting devices (not shown), the so-called flag, i.e. the spacing between a line of perforation 12 and a weld line 12', can be set with great accuracy, even when the machine 1 is in operation. This is a major advantage over known bag-making machines where the operation of the knife and the welding station is controlled by one and the same coupling.

Since the cutting means 10 has two knives 11, the bag length can be halved if so desired, as compared with the possibilities in known bag-making machines. The minimum bag length instead becomes f x the spacing between the centre of rotation of the cutting means 10 and the knife edges.

In FIG. 3, the cutting means 10 is shown with its upper knife 11 in the stop position making a certain angle with the point of impact on the back-up roller 5. The angle, here called impact angle $\alpha$, is adjustable, but in the case of two knives 11, should be about 90°. When the cutting means 10 is activated by the angle sensor 13, the knife 11 is accelerated when rotated towards the back-up roller 5 and, optimally, the angle velocity of the knife is constant at the very impact. The movement of the knife 11 is thereafter decelerated, preferably through an equally large angle. Thus, the knives 11 change places in connection with each impact. Because of the necessary limitations owing to the fact that the knife and the welding station are mechanically interconnected, the impact angle in known bag-making machines is of the order of 45° or less. In such cases, the knife will not have time to attain a constant angular velocity, which is necessary to have the perforation made in a reliable way. This limits the speed of operation of the known machine.

By means of the arrangement according to the invention, the cutting means 10 operates in such a manner that, for each impact, the angle of rotation of the two knives 11 is divided into an angle of acceleration and a substantially equally large angle of deceleration. It is evident that the knife 11 will thus have a constant angular velocity when impinging on the back-up roller 5.

The step couplings 14, 15, 16 essential to the arrangement according to the invention are pneumatic and, as stated above, extremely quick-acting. Connection and disconnection of the step coupling 14 for controlling the rotation of the cutting means 10 is carried out in a very short time, about 10–20 μs, and with very high accuracy.

Although the cutting means 10 here described has two knives 11, it is of course conceivable to use only one knife or several knives. In the case where only one knife is used, the cutting means 10 is preferably controlled in such a manner that its impact angle $\alpha$ is in the range of 45–270° and preferably about 180°. It is evident that an impact angle $\alpha$ of 180° implies that the cutting means 10 is rotated one revolution for each impact. If the cutting means 10 has three or four knives, these are distributed equiangularly on the cutting means 10 in such a manner that their stop position before impact, i.e. the impact angle $\alpha$ is at least 45° for the same reason as stated in the foregoing.

Finally, it should be pointed out that the invention is in no way to be considered restricted to the embodiment described above, but several different modifications are possible within the spirit and scope of the accompanying claims. For instance, the cutting means can be provided with other types of knives, and other step couplings can be used. The inventive principle however remains the same, i.e. that the cutting means 10 and the welding units 8 should be separately connectible and disconnectible independently of other drive means.

I claim:

1. A bag-making machine for forming bag-defining lines of perforation and weld lines in an elongated web which is moving in a direction of travel, said machine comprising, a nip roller and a backup roller which provide a roller nip for feeding the elongate web through the machine, a cutting means which is elongated in a direction parallel to said rollers, said cutting means being rotatable about its longitudinal axis, said cutting means being movable into engagement with said backup roller to form lines of perforation in said web, a welding station having sealing jaws which are displaceable in the direction of travel of the web and are movable into engagement with the web to form weld lines in the web while the web is moving, at least one drive motor for driving said machine, first coupling means for adjusting the spacing between two consecutive lines of perforation by connecting and disconnecting the cutting means from a said drive motor independently of the operation of the roller nip, and second coupling means for adjusting the spacing between the weld lines and the lines of perforation by separately connecting and disconnecting the welding station from a said drive motor.

2. A bag-making machine according to claim 1 wherein the first coupling means is operable to provide stepwise rotation of the cutting means through predetermined angles, and the second coupling means is operable to provide stepwise displacement of the sealing jaws.

3. A bag-making machine according to claim 2 wherein the cutting means has only one cutting edge which is disposed transversely of the web and is rotatable by the action of the first coupling means to move said cutting edge from a stop position through an angle in the range of 45 to 270 degrees before impinging on the backup roller.

4. A bag-making machine according to claim 2 wherein the cutting means has at least three cutting edges which are mounted on the cutting means at equal angular spacings, each of said cutting edges being movable from a stop position through an angle of at least about 45 degrees to a point of impact on the back-up roller.

5. A bag-making machine according to claim 2 wherein the cutting means has two diametrically disposed cutting edges which are each movable from a s top position through an angle of about 90 degrees before impinging on the back-up roller.

6. A bag-making machine according to claim 1 wherein the cutting means has a cutting edge which is movable from a stop position through an angle of rotation, wherein the angle of rotation of the cutting edge for each cut includes an angle of acceleration and a substantially equal angle of deceleration, said cutting edge having a constant angular velocity with impinging on the back-up roller.

7. A bag-making machine according to claim 1 wherein the welding station includes at least two welding units having sealing jaws which are movable toward each other from opposite sides into engagement against the web, said sealing jaws moving at a same speed as the web during the welding operation.

8. A bag-making machine according to claim 7 wherein said second coupling means includes two couplings for providing stepwise rotation, said two couplings being controlled in response to operation of the first coupling means.

9. A bag-making machine according to any one of claims 1–8 having a first sensor for measuring the web length and for providing a connecting signal to at least one of said coupling means, and a second sensor for measuring the rotation of said one of said coupling means and for providing a disconnecting signal to at least one of said coupling means, said coupling means being operable to effect connections and disconnections in about 10 to 20 microseconds.

* * * * *